United States Patent [19]

Ouchi et al.

[11] Patent Number: 4,723,530

[45] Date of Patent: Feb. 9, 1988

[54] CAPACITOR DISCHARGE TYPE IGNITION DEVICE

[75] Inventors: Katsuhiro Ouchi, Urawa; Sumitaka Ogawa, Omiya; Masayuki Kudo, Shiki; Nobuo Miura, Wako, all of Japan

[73] Assignee: Honda Giken Kogyo KK, Tokyo, Japan

[21] Appl. No.: 867,984

[22] Filed: May 29, 1986

[30] Foreign Application Priority Data

Aug. 26, 1985 [JP] Japan ..... 60-129865[U]

[51] Int. Cl.[4] ..... F02P 1/00

[52] U.S. Cl. ..... 123/599; 123/598

[58] Field of Search ..... 123/599, 598

[56] References Cited

U.S. PATENT DOCUMENTS

| | | | |
|---|---|---|---|
| 3,636,936 | 1/1970 | Schuette | 123/598 |
| 3,646,605 | 2/1972 | Plume | 123/599 |
| 3,842,816 | 10/1974 | Vargas | 123/598 |
| 3,885,541 | 5/1975 | Hufton | 123/598 |
| 4,149,509 | 4/1979 | Mathieu | 123/599 |
| 4,176,643 | 12/1979 | Beeghly | 123/599 |
| 4,478,200 | 10/1984 | Nagashima | 123/599 |
| 4,537,174 | 8/1985 | Nagasawa | 123/599 |

*Primary Examiner*—Ronald B. Cox

*Attorney, Agent, or Firm*—Pollock, Vande Sande & Priddy

[57] ABSTRACT

An ignition device of the capacitor discharge type for small automobiles or two-wheeled vehicles, having an A.C. generator with a converter which transforms the alternating current supplied by a stator coil into direct current, increasing the voltage. Ignition voltage is provided by a charging control which releases the charge stored in a capacitor with the required timing.

2 Claims, 5 Drawing Figures

CAPACITOR DISCHARGE TYPE IGNITION DEVICE

FIELD OF THE INVENTION

The present invention relates to an ignition device for a gasoline engine for a two-wheeled vehicle or automobile, in particular, to a capacitor discharge type ignition device where a charge stored in a capacitor is released at the proper moment into an ignition coil.

PRIOR ART

Prior art ignition devices for this purpose are usually of the fully transistorized type, of the capacitor discharge type or of the DC-DC converter type.

In the fully transistorized type of ignition device shown in FIG. 3, primary coil 16A of ignition coil 16 can be supplied with voltage by switching transistor 30 on and off. When high voltage is induced in secondary coil 16B, spark plug 17 sparks. In the figure, 13 is a battery power source, 154 is a rectifying diode, and 155 is a pulser coil which provides the voltage to drive the base of transistor 30. Voltage is induced into pulser coil 155 at the required timing by the rotor in the alternating current generator (not shown).

Since battery 13 is the power source, power is supplied in the initial starting period when the rpm level is still low, until stable operation of the engine is achieved. This arrangement is defective in that, if the battery is dead, ignition function ceases abruptly. For this reason this type of device is primarily used in automobiles and large motorcycles which are capable of holding a large high storage capacity battery. It has never been the arrangement of choice for small and mid-sized cycles.

FIG. 4 shows a capacitor discharge type of ignition device. This type of device uses an alternating current generator 10 as a power source, and since battery 13 is not used as the power source, it does not have the above-noted disadvantages associated with the fully transistorized ignition device. In this figure, alternating current generator 10 is composed of a stator coil 10A which generates power to charge battery 13, a stator coil 10B which supplies power to light headlight 11, and a stator coil 10C which is provided for the ignition device. 12 is a rectifying diode. The power generated by coil 10C is supplied to a charge-discharge control means 15 equipped with a rectifying diode 151, a charge-discharge capacitor 152, a thyristor 153 to form a discharge path, and a rectifying diode 154 to provide the voltage to drive thyristor 153.

The voltage generated in coil 10C (generally 80 to 400 V) is used to charge capacitor 152 via diode 151. By having the pulser coil 155 turn on the thyristor 153 at the voltage generating timing, capacitor 152 discharges to provide a large voltage to primary coil 16A of ignition coil 16. This generates an ignition voltage (10 to 40 V) in secondary coil 16B.

The advantage of this type of ignition device is that it does not rely on a battery as a power source, as pointed out above. However, when the engine rpm level is low, e.g., when the engine is being started, the revolutions of the alternating current generator are also low, so that it is difficult to generate a sufficiently high voltage to obtain a strong ignition spark. In addition, it is also necessary to have a coil 10C established as a part of the charge-discharge control means 13 inside the alternating current generator and to have another coil 10A for charging the battery and yet another coil 10B for the headlights. Finding sufficient space for all these coils can be a problem. In other words, since this places large restrictions on the alternating current generator overall, in order to increase the voltage generated by coil 14C it is necessary to increase the number of its windings, so that very little space is available for coils 10A and 10B. This ultimately results in a decreased output voltage. Conversely, if there is an attempt to maintain voltage for charging the battery and lighting, the amount of voltage supplied to control means 15 declines, and this too is undesirable.

FIG. 5 shows a prior art DC-DC converter type ignition device in which an approximate 12 V output for battery 13 is fed into a DC-DC converter to increase it to the vicinity of 400 V, after which it is used to drive charge-discharge control means 15. As in the case of the fully transistorized ignition device, this device depends upon battery power, so if the battery is dead, it will not operate. Thus it has the same disadvantage as was already mentioned above.

SUMMARY OF THE INVENTION

The present invention was developed in order to overcome the above described problems, by means of a capacitor discharge type ignition device which is not dependent upon battery power for its operation, while providing for a stable source of ignition voltage even when the engine rpm level is low without the need for a new coil in the alternating current generator.

In order to achieve this objective, the current from the existing coil from the alternator is converted into direct current and the voltage is elevated so that a high voltage can be supplied to the spark plug by charging a capacitor.

In one embodiment of the invention, the alternating current supplied from an existing coil is rectified and elevated to the desired voltage level by a DC-DC converter. In another embodiment of this invention, the alternating current supplied from the existing coil is rectified by passing it through a voltage doubler rectifying circuit, and then using a DC-DC converter to increase the voltage to the desired level.

BRIEF DESCRIPTION OF THE DRAWINGS

In order that the invention may be more clearly understood, reference will now be made to the accompanying drawings, in which several embodiments of the invention are shown for purposes of illustration, and in which.

DESCRIPTION OF PREFERRED EMBODIMENTS

Figure 1:
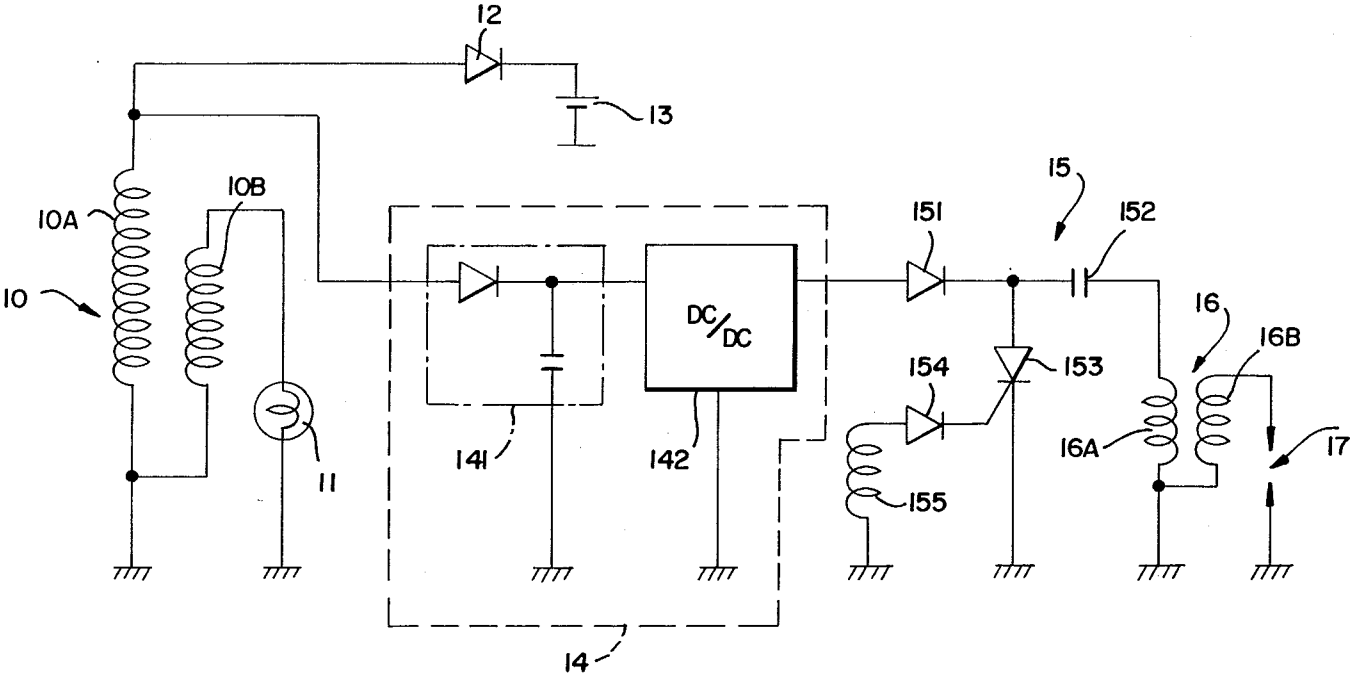
FIG. 1 is an electrical diagram of a first embodiment of a capacitor discharge type ignition device according to the invention.

FIG. 1 shows an alternating current generator 10 which has a battery charging stator coil 10A and a lamp lighting coil 10B. 11 is a lamp, such as a headlight, 12 is a diode for rectifying, 13 is a battery, 14 is an alternating current converter control means, 15 is a charge-discharge control means, 16 is an ignition coil composed of a primary and secondary coil, and 17 is an engine ignition coil.

The alternating current control means 14 is composed of a rectifier circuit 141 with a diode and capacitor and a DC-DC converter 142 of the type which is universally known in the art. If the rectifier circuit 141 can obtain a direct current, it does not matter whether it is of the half wave rectifying or full wave rectifying type. The alternating current control means 14 supplies power from the battery charging coil 10A of the alternating current generator 10. The charge-discharge control means 15 is composed of a rectifying diode 151, a charge-discharge capacitor 152, a thyristor 153 for forming the discharge path, and a rectifying diode and coil 155 to provide the voltage to drive this thyristor 153. The pulse coil 155 is placed inside the alternating current generator 10 in an appropriate location; it generates an alternating voltage of the desired timing in conjunction with the rotation of the rotor.

The device according to this embodiment operates as follows:

An alternating current of several tens of volts which is generated by coil 10A in conjunction with the rotation of the engine is converted into direct current by the rectifier circuit 141. The DC-DC converter 142 then increases the voltage to several hundred volts. The capacitor 152 is charged by this voltage. If the capacity of the capacitor is fixed, the higher the charging voltage, the higher the energy of the stored charge.

The pulse voltage provided by thyristor 153 via pulse coil 155 and diode 154 provides a rapid release of this stored charge when it is turned on. The current from the stored energy in the capacitor 152 flows in a closed circuit between the capacitor 152, the thyristor 153 and the primary coil 16A, with the impedance of coil 16A causing a large oscillation current to be generated, which creates a high voltage of several tens of kilovolts in the secondary coil 16B. This high voltage is sufficient to cause the spark plug 17 to spark.

This charge and discharge cycle is repeated continuously in conjunction with the rotation of the engine. In other words, the capacitor 152 charges—thyristor 153 switches on—and then capacitor 12 is discharged and the cycle repeats. The time constant for the charging and discharging of capacitor 152 and pulse coil 155 voltage generation timing can be appropriately selected. Thyristor 153 is reverse biased by the oscillation current which accompanies the discharge of capacitor 152.

In this way, DC-DC converter 142 provides for the elevation of the voltage generated by alternating current generator 10 so that, even if the level of engine rpm is low, capacitor 152 can obtain a sufficient charge of electricity.

Figure 2:
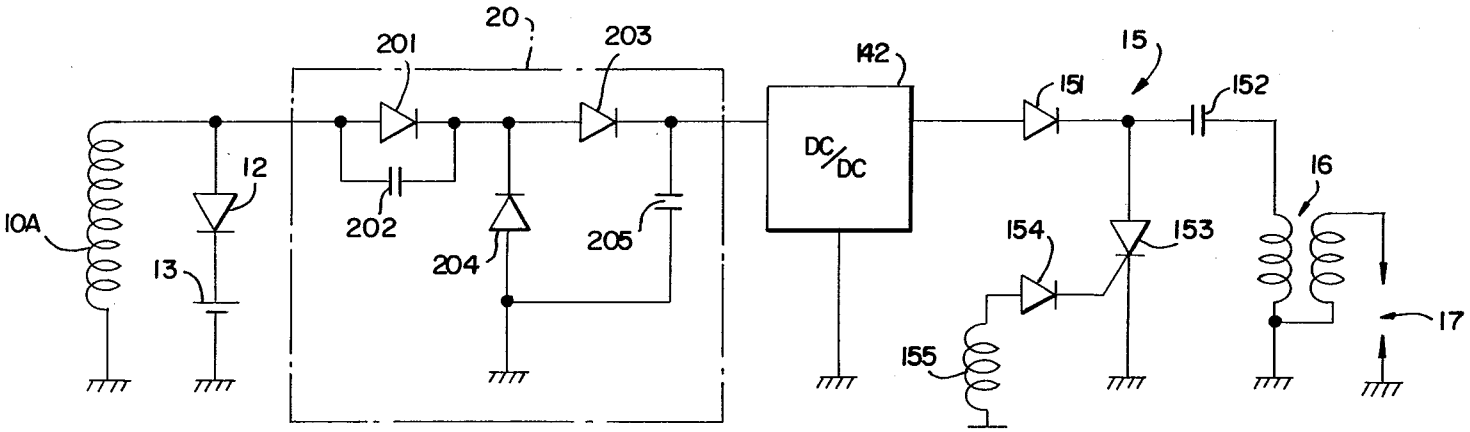
FIG. 2 is an electrical diagram of a second embodiment discharge type ignition device according to the invention.
Figure 4:
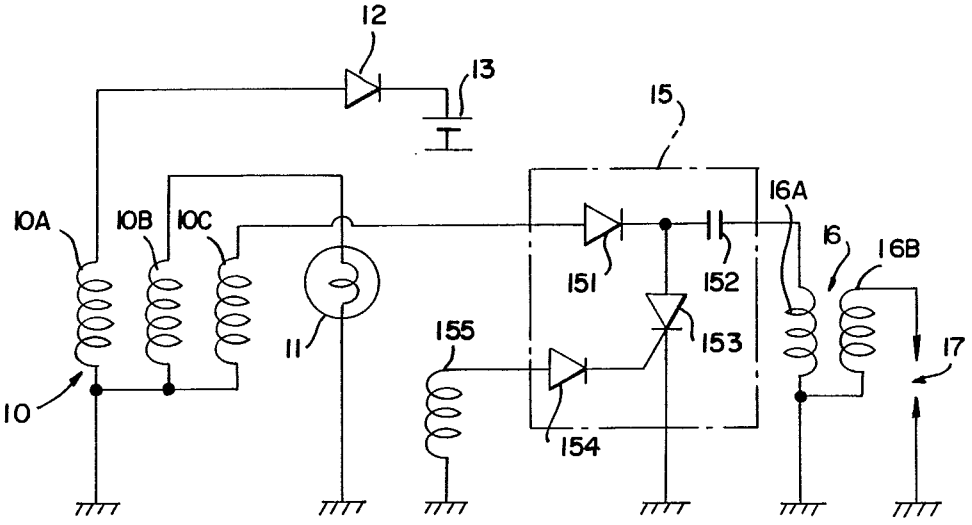
FIG. 4 shows a prior art ignition device of the capacitor discharge type.
Figure 5:
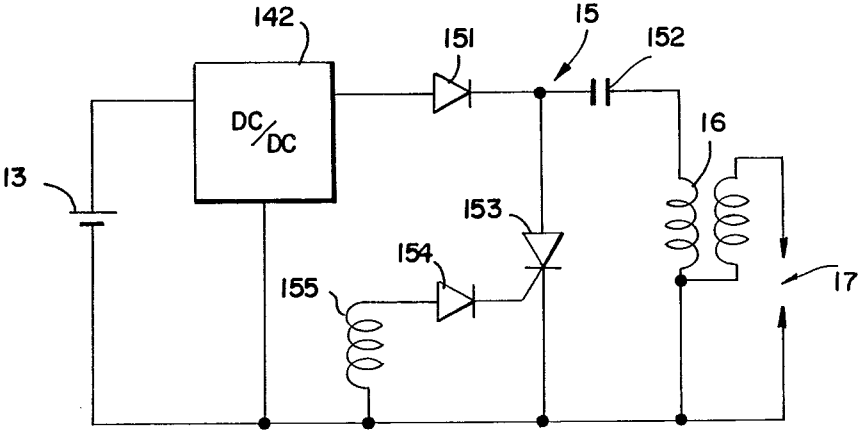
FIG. 5 shows a prior art ignition device of the DC-DC converter type.
Figure 3:
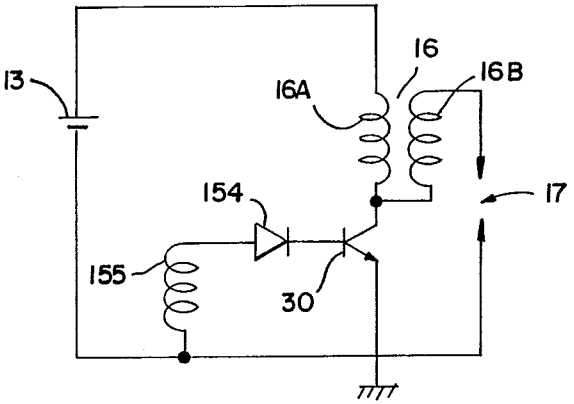
FIG. 3 shows a prior art ignition device of the fully transistorized type.

FIG. 2 shows another embodiment of the capacitor discharge type of ignition device which is the subject of this invention. In this embodiment, instead of rectifier circuit 141 in alternating current voltage conversion control circuit 14, there is a voltage doubler rectifier circuit 20. In other respects, there is no difference from the preceding embodiment.

The voltage doubler rectifier circuit 20 is made up of a diode 201 and capacitor 202 connected in parallel, two diodes 203, 204, and a capacitor 205. During the interval when a positive voltage is output from coil 10A of alternating current generator 10, current does not flow through diode 201, the discharge current from capacitor 202 flows through coil 10A and diode 204. In other words, since the current from the discharge of capacitor 202 is added to the current accompanying the induction power for coil 10A, the charge-discharge voltage of capacitor 202 is added to the induction power generated by coil 10A, and this is impressed upon capacitor 142 via diode 203 and capacitor 205 so that the maximum voltage value is about double that of the induction power for coil 10A.

Accordingly, compared with the example shown in FIG. 1, even though induction power from generator 10 is the same, a high voltage is available to charge capacitor 152 for the ignition. The energy stored in the capacitor is greater than the voltage in the secondary of ignition coil 16. Also, even when there is a low level of power generated by the alternating current generator 10, it is still possible to get the desired capacitor charging voltage. This effect is of important practical application. Further, it is not necessary to increase the windings in coil 10A, which allows much more freedom in the design of the generator.

It is entirely within the capacity of those of ordinary skill in the art to modify the described embodiments without departing from the scope of the invention. For example, the rectifier circuits in the above mentioned examples were described simply as diodes, but several well known types of rectifier circuits could of course be substituted.

The invention enables the supply of alternating current from an existing coil of an alternating current generator which is transformed electrically or electronically to a high voltage so that there is no need to depend upon a battery as a power source for ignition. In addition, it obviates the addition of a further coil to the alternating current generator, and it allows for a high ignition voltage even at times when the engine rpm level is low in this capacitor discharge type of ignition device.

What is claimed is:

1. A capacitor-discharge type ignition system comprising:

a vehicle alternating current generator, a current converting means including a voltage doubler rectifier circuit connected in series with DC-DC converter, said voltage doubler being connected to a stator coil of said generator for receiving first low AC signals, and converting said first low AC signals into first low DC signals, and said converter receiving said first low DC signals and converting them into second high DC signals, a charging control means for receiving said second high DC signals and charging a capacitor and discharging energy stored in said capacitor with the required timing, thereby providing a high ignition voltage.

2. A capacitor discharge type ignition system according to claim 1 wherein said voltage doubler includes a first parallel circuit having a first diode and a first capacitor connected in series with said stator coil, and a second parallel circuit having a second diode and a second capacitor said second circuit connected in parallel to said series connection of said first parallel circuit and said coil.

* * * * *